United States Patent [19]

Kinzler

[11] Patent Number: 4,596,197

[45] Date of Patent: Jun. 24, 1986

[54] COKE OVEN DOOR

[75] Inventor: Raymond C. Kinzler, Collier Township, Allegheny County, Pa.

[73] Assignee: Raymond Kaiser Engineers Inc., Oakland, Calif.

[21] Appl. No.: 690,661

[22] Filed: Jan. 10, 1985

[51] Int. Cl.[4] ..... F23M 7/00

[52] U.S. Cl. ..... 110/173 R; 202/248

[58] Field of Search ..... 202/248, 269; 110/173 R; 126/198, 200

[56] References Cited

U.S. PATENT DOCUMENTS 3,567,590 3/1971 Reinfeld ..... 202/248

4,216,062 8/1980 Kelly ..... 202/248

FOREIGN PATENT DOCUMENTS 679871 8/1939 Fed. Rep. of Germany ... 110/173 R

*Primary Examiner*—James C. Yeung

*Attorney, Agent, or Firm*—Flehr, Hohbach, Test, Albritton & Herbert

[57] ABSTRACT

A door construction for the door frame of a coking oven having a seal comprising a sheet metal diaphragm with a perimeter flange which engages and forms a seal with respect to a sealing surface of the oven door frame. Threaded studs each have an end secured to the diaphragm and extend through holes in a rigid door plate. Nuts have threaded engagement with each stud and serve to adjustably fix each stud to the door plate whereby each stud may be adjusted to apply forces to the diaphragm in directions toward or away from the door plate.

3 Claims, 2 Drawing Figures

COKE OVEN DOOR

This invention relates generally to door constructions for use with coking ovens. More particularly it relates to doors having sealing means for preventing or minimizing leakage of gases from the oven during a coking cycle. The invention as disclosed is applicable to the construction of leveler doors.

Leakage of gases past the closed doors of coking ovens has been recognized as a serious problem. Aside from objectionable pollution of the air by such leakage, coal tar and other contaminates carried by the gas tend to deposit on the sealing surfaces in the regions where leakage occurs. Such deposits must be removed after coke has been discharged from the oven and before the next cooking cycle. Clean up operations for this purpose are time consuming and are generally carried out by special equipment which removes the deposits by scraping action. Various door constructions have been employed or proposed for minimizing such gas leakage. For example, as shown in U.S. Pat. No. 3,785,932 Jan. 15, 1974, the sealing surface carried by the oven door is a knife edge which is urged toward the sealing surface of the door jamb by a system or rocker levers. Other constructions using a knife edge type of sealing means are shown in U.S. Pat. No. 3,834,995 Sept. 10, 1974, and U.S. Pat. No. 3,897,310 July 29, 1975. U.S. Pat. No. 3,567,590 Mar. 2, 1971 shows a leveler door having sealing means of the knife edge type.

Although prior developments as referred to above make for improved sealing, more effective and simpler sealing arrangements are desired in the coking industry, making possible less gas leakage with the result that deposits on the sealing surfaces are prevented or minimized and air pollution is avoided.

In general an object of the present invention is to provide a more effective sealing arrangement for coke oven doors which make possible adjustments that provide effective sealing for the entire perimeter of a knife edge type of sealing means.

Another object of the invention is to provide a coke oven door which has sealing means that is adjustable in such a manner that gas leakage detected in a particular area of the seal can be corrected by individual adjustment without disturbing the remaining portions of the seal.

Another object is to provide a door construction in which the forces required to urge the sealing surfaces together are reacted by a relatively heavy door member.

A further object is to provide a leveler door for coke ovens which has novel and effective sealing means of the knife edge type.

In general the present invention consists of a door applicable to the door frame of a coking oven, the frame having a planar sealing surface and the door having sealing means cooperating with the sealing surface of the frame. The construction comprises a diaphragm made of sheet metal which has a continuous perimeter flange forming a continuous knife edge. The knife edge is adapted to engage and form a seal with respect to the sealing surface of the jamb. A substantially flat rigid door plate extends parallel to the diaphragm and is spaced therefrom. The door plate carries adjustable means at spaced locations disposed to engage and adjustably apply a thrust to the diaphragm, the adjustable means also serving to secure the diaphragm to the door plate. The door is secured to the door jamb by hinge means whereby the door may be swung on a vertical axis between closed and open positions. In closed position of the door the knife-like sealing edge engages the sealing surface of the door jamb. Means is provided for locking the door in closed position, which applies yieldable force to a central area of the door plate. Separate adjustments of the adjustable means serves to adjust selective portions of the knife edge relative to the sealing surface of the door jamb. Preferably a heat shield is disposed on the oven side of the diaphragm and is secured to a central area of the diaphragm.

Additional objects and features of the invention will appear from the following description in which the preferred embodiment has been set forth in detail in conjunction with the accompanying drawing.

REFERRING TO THE DRAWING

Figure 2:
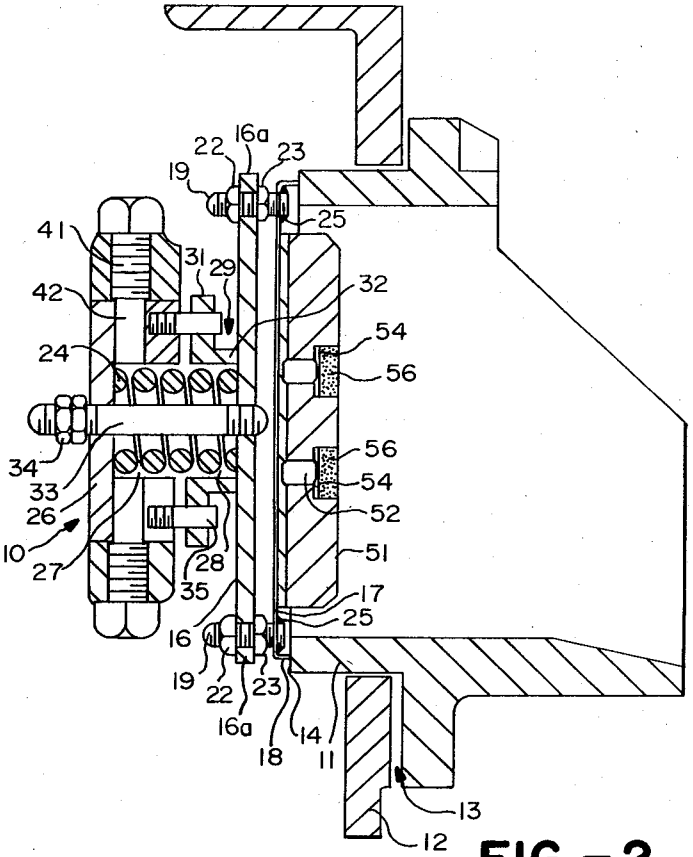
FIG. 2 is a cross-sectional view taken along the line 2—2 of FIG. 1.

The door shown in the drawing is intended for installation on the pusher side of a coke oven chamber. When fresh coal has been charged into a coking chamber, it is conventional practice to open the leveler door and then level the charge in the oven by application of a leveler bar. Tne door designated generally at 10, is carried by and cooperates with the leveler door frame 11. This frame 11 is carried by the frame 12, which forms a structural part of the coke oven. The two frames are secured together as by means of bolts (not shown), and a packing 13 of heat insulating material is interposed between the two parts. The leveler door frame is machined to provide the planar (i.e. flat) sealing surface 14.

Figure 1:
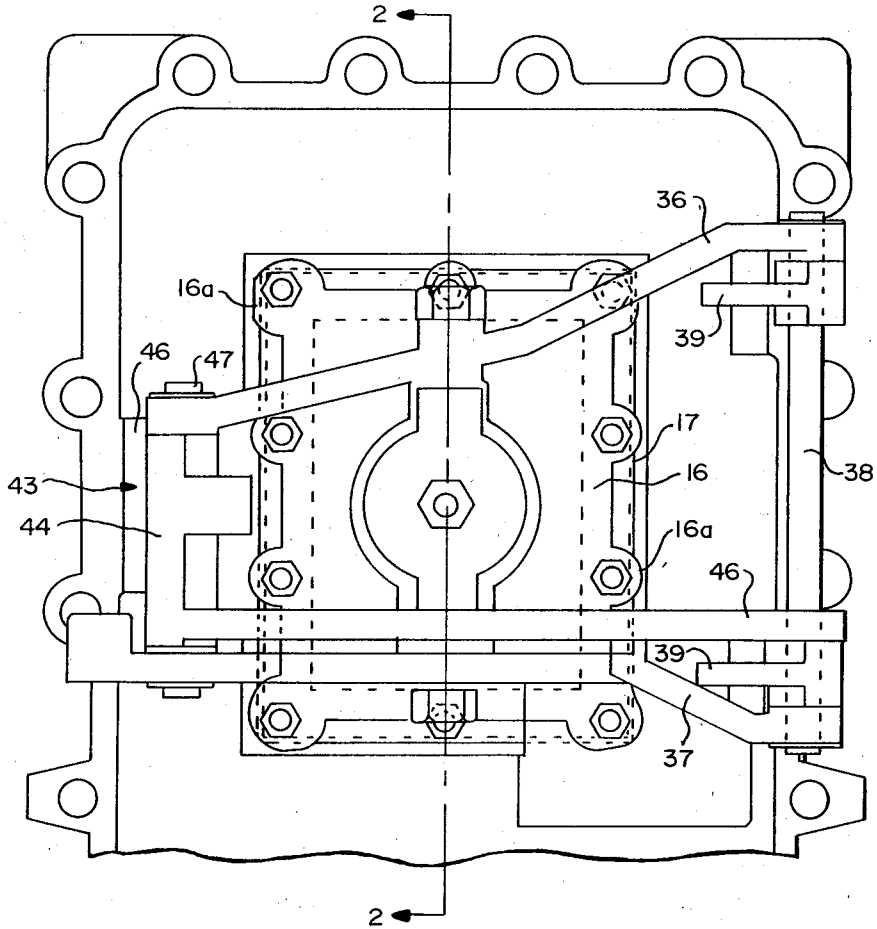
FIG. 1 is a front elevational view of a leveler door for coke ovens, incorporating the present invention.

The door construction consists of a relatively heavy steel plate 16 which may have a configuration substantially as illustrated in FIG. 1. Thus the plate in this instance is generally rectangular, with protruding portions **16*a* along the side and upper and lower edges. A diaphragm 17, which may be made of sheet metal, such as a suitable heat resistant steel alloy which has spring characteristics, is carried by the door 16. For example it may be made of 10 gauge stainless steel. The main body of the diaphragm is planar and its perimeter is provided with flanges 18, which form knife sealing areas. The flanges are preferably integral with the body of the diaphragm, as illustrated, or may be separately welded to the perimeter of the diaphragm. At spaced intervals about the margin of the door plate 16, threaded studs 19 are provided which are fixed to the diaphragm in spaced locations adjacent to but spaced inwardly from the flange 18. The holes 21 for receiving these studs as shown in FIG. 1 are in the protruding portions 16*a* of the door plate 16. The two nuts 22 and 23, which are threaded upon each of the studs 19, are arranged to bear upon the side surfaces of the door plate. The studs 19 are secured to the diaphragm by means of a suitable weld connection 25. With this arrangement each stud can be adjusted relative to the door plate 16 by loosening and tightening the nuts 22 and 23**.

The door assembly also includes a coiled compression spring 24 and member 26 which forms a spring box. One end of the spring is seated within a recess 27 formed in the spring box, and the other end is seated within a recess 28, formed by the annular spring retainer 29. The retainer includes the annular flange 31, and the annular member 32 which connects the flange to the door plate. The flange 31 and annular member 32 may be fabricated together with the door plate, as by welding.

A stud 33 is secured to the center of the door plate 16, and its outer end is threaded and provided with lock nuts 34. These nuts can be adjusted to apply a desired amount of compression to the spring 24.

Pins or studs 35 are secured to the inner side of the spring box and are loosely accommodated in holes formed in flange 31.

The spring box 26 is connected to supporting and locking means similar to that illustrated in the aforesaid Patent No. 3,567,590. Thus upper and lower supporting bars 36 and 37 are provided, which have their ends at one side of the door hingedly carried by the vertical shaft 38, which in turn is carried by brackets 39 that are attached to the door frame 12. Threaded studs 41 are secured to bars 36 and 37 and their portions 42 form pivotal connections with the box. The other ends of the bars 36 and 37 are connected to latching means 43. This may consist of a latch member 44 which is secured to one end of the latching lever 46 and which is carried by shaft 47. The right hand end of the latch lever as illustrated in FIG. 1 carries latching means (not shown), which provides latching engagement with the shaft 38. The latch member 44 is provided with a projecting locking member (not shown) that engages beneath a bracket 46 when the lever 46 is in its latched position shown in FIG. 1, thus locking the door in closed position.

The oven side of diaphragm 17 is provided with a heat shield 51. This can be made of suitable material such as heat resistant ceramic. Its central portion is attached to the central area of the diaphragm by studs 52, each of which at one end are attached to the diaphragm, and at the other end fixed to washer 54 as by welding. The washers and the adjacent ends of the studs are shown disposed in recesses 56, which are filled with the heat resistant cement.

Before installing the door on a coke oven it is desirable to adjust the studs 19 and nuts 22 and 23 whereby the sealing edge formed by the flange 18, is coincident with a plane. One simple way to make this adjustment is to place the diaphragm on a surface plate or flat ground surface which is true. Thereafter the door plate 16 is lowered onto the studs 19, and the nuts 22 applied. The nuts 23 are now adjusted until the sealing edge of the diaphragm appears to engage the underlying surface for its entire perimeter. The top jamb nuts 22 are then turned to finger tightness, and the sealing surfaces at various locations about the perimeter of the diaphragm are checked to locate any places where the surfaces show a gap more than a permissable amount, as for example more than 0.001 inches. If a gap greater than is permissible is found, the nuts 22 and 23 at that location are adjusted to eliminate or reduce the gap to within permissible limits. When these operations are completed, the nuts 22 are made tight. Thereafter the door is completely assembled and installed on the coke oven. During a coking cycle, checking of the seal may locate areas where some leakage is occurring. At that time the nuts 22 and 23 of the stud nearest the location of leakage can be adjusted to reduce or minimize any spacing between sealing surfaces, thus eliminating leakage without disturbing the other sealing surfaces.

What is claimed is:

1. A door construction applicable to the door frame of a coking oven, the frame having a planar sealing surface and the door having sealing means cooperating with the sealing surface, the door construction comprising:

a. a diaphragm made of sheet metal having a continuous perimeter flange forming a continuous sealing knife edge, the sealing edge being coincident with a plane and adapted to engage and form a seal with respect to the planar sealing surface of the frame;

b. a rigid door plate extending parallel to the diaphragm and spaced therefrom, the plate having holes at spaced locations along the margin of the plate;

c. adjustable means secured to the diaphragm at spaced locations adjacent to but spaced inwardly from the flange and in alignment with said holes in the door plate, the adjustable means consisting of threaded studs disposed in the holes of the door plate, each of the studs having one end fixed to the diaphragm and adjustably fixed to the door plate by nuts directly engaging the two side surfaces of the plate, whereby each stud may be adjusted to apply forces to the diaphragm in directions either toward or away from the door plate;

d. hinge means for attaching the door to the door frame whereby the door may swing on a vertical axis from open to closed position with the sealing edge of the diaphragm flange engaging the sealing surface of the frame; and e. means for locking the door in closed position, said means including means for applying yieldable force to a central region of the door plate.

2. A door construction as in claim 1 in which the main portion of the diaphragm is a continuous sheet having the flange secured to its perimeter, the studs forming the sole means for securing the diaphragm to the door plate.

3. A door construction as in claim 1 in which a heat shield is disposed on the oven side of the diaphragm and is secured to a central region of the diaphragm.

* * * * *